US011555331B2

(12) United States Patent
Johns

(10) Patent No.: US 11,555,331 B2
(45) Date of Patent: Jan. 17, 2023

(54) BARRIER CONTROL SYSTEM

(71) Applicant: William D. Johns, Arlington, VA (US)

(72) Inventor: William D. Johns, Arlington, VA (US)

( * ) Notice: Subject to any disclaimer, the term of this patent is extended or adjusted under 35 U.S.C. 154(b) by 67 days.

(21) Appl. No.: 17/127,769

(22) Filed: Dec. 18, 2020

(65) Prior Publication Data

US 2022/0195751 A1 Jun. 23, 2022

(51) Int. Cl.

| | |
|---|---|
| ***E05F 15/00*** | (2015.01) |
| ***E05B 43/00*** | (2006.01) |
| ***E05B 47/00*** | (2006.01) |
| ***E05F 15/611*** | (2015.01) |
| ***E05F 15/79*** | (2015.01) |
| ***E05F 15/73*** | (2015.01) |
| ***G07C 9/00*** | (2020.01) |

(52) U.S. Cl.

CPC ..... *E05B 43/005* (2013.01); *E05B 47/0001* (2013.01); *E05F 15/611* (2015.01); *E05F 15/73* (2015.01); *E05F 15/79* (2015.01); *G07C 9/00817* (2013.01); *E05F 2015/767* (2015.01); *E05Y 2201/434* (2013.01); *E05Y 2400/44* (2013.01); *E05Y 2400/45* (2013.01); *E05Y 2900/132* (2013.01); *G07C 2009/00841* (2013.01)

(58) Field of Classification Search

CPC . E05F 15/40; E05F 15/63; E05F 15/73; E05F 15/77; E05F 3/22; E05F 15/74; E05F 2015/631; E05F 15/611; E05F 15/79; E05F 2015/767; E05Y 2400/32; E05Y 2400/322; E05Y 2400/45; E05Y 2201/434; E05Y 2400/44; E05Y 2900/132; G01B 7/003; G01B 7/14; E05B 43/005; E05B 47/0001; G07C 9/00817; G07C 2009/00841

USPC ..... 49/29

See application file for complete search history.

(56) References Cited

U.S. PATENT DOCUMENTS

| | | | | |
|---|---|---|---|---|
| 8,261,491 | B2 * | 9/2012 | Yulkowski | E05F 15/00 49/300 |
| 11,002,061 | B1 * | 5/2021 | Maiga | E05F 15/48 |
| 11,136,812 | B2 * | 10/2021 | Rabinowitz | E05F 15/624 |
| 11,174,664 | B2 * | 11/2021 | Sellinger | E05F 3/226 |
| 2003/0090364 | A1 * | 5/2003 | Cardinale | E05B 43/005 340/5.73 |
| 2010/0242369 | A1 * | 9/2010 | Laird | E05F 15/684 49/358 |
| 2011/0016971 | A1 * | 1/2011 | Yulkowski | E06B 7/28 73/493 |
| 2013/0326960 | A1 * | 12/2013 | Manseder | E05F 15/624 49/358 |
| 2018/0051509 | A1 * | 2/2018 | German | E06B 5/18 |
| 2019/0145138 | A1 * | 5/2019 | Eickhoff | E05F 3/22 340/5.7 |
| 2019/0153764 | A1 * | 5/2019 | Baumgarte | E05F 15/63 |
| 2019/0330885 | A1 * | 10/2019 | Telljohann | E05B 41/00 |

* cited by examiner

*Primary Examiner* — Chi Q Nguyen

(74) *Attorney, Agent, or Firm* — The Iwashko Law Firm, PLLC; Lev Ivan Gabriel Iwashko

(57) ABSTRACT

A barrier control system running a program thereon, the barrier control system including a main body, a control unit disposed within at least a portion of the main body to execute the program to control operations of the main body, and at least one control device connected to the control unit to control operations of the main body through the control unit based on the program.

16 Claims, 2 Drawing Sheets

BARRIER CONTROL SYSTEM

BACKGROUND

1. Field

The present general inventive concept relates generally to a control system, and particularly, to a barrier control system.

2. Description of the Related Art

Barriers are an important means of obstruction of movement. In particular, barriers can prevent and/or restrict access to a building and/or a property. As such, barriers provide security by controlling access within the building and/or the property.

There are many different types of barriers, such as doors, fences, gates, rails, and bollards. A door is the most used type of barrier because the door is used both outside and inside. Moreover, the door has many ways to be constructed and/or designed depending on its use.

Many doors have handles and locks installed on a door leaf. In other words, the handles and locks are retrofit onto the door leaf. However, the door locks and/or the handles are not always able to fit in the door leaf.

Typically, many other components used for security, such as cameras, lights, and/or doorbells are separate from the door. For example, the cameras, the lights, and/or the doorbells are usually connected to a wall around the door and/or a casing of the door. The placement of these other components can complicate installation of security because there may not be space.

Therefore, there is a need for a barrier control system that is integrated on the barrier.

SUMMARY

The present general inventive concept provides a barrier control system.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a barrier control system running a program thereon, the barrier control system including a main body, a control unit disposed within at least a portion of the main body to execute the program to control operations of the main body, and at least one control device connected to the control unit to control operations of the main body through the control unit based on the program.

The main body may include a latch movably disposed within at least a portion of an interior of the main body to perpendicularly extend away from the interior of the main body with respect to a lateral direction, and a deadbolt movably disposed within at least a portion of the interior of the main body to perpendicularly extend away from the interior of the main body with respect to the lateral direction.

The control unit may include at least one motor connected to main body, the latch and the deadbolt to move the main body, the latch, and the deadbolt in response to rotation of the at least one motor.

The at least one motor may be a hinge of the main body.

The at least one control device may schedule a time for a schedule for events for the main body and the control unit.

The at least one control device may use the program to learn operation patterns to perform the schedule for events based on defects occurring within the main body and the control unit a number of times.

The at least one control device may schedule a time for a schedule for moving the main body and the at least one motor.

The at least one control device may use the program to learn operation patterns to perform the schedule for moving the main body and the at least one motor based on movement occurring within a predetermined time.

The barrier control system may further include an input unit disposed on at least a portion of the main body to receive an input thereon, such that the control unit executes the program to compare the input to at least one authorized input.

The input unit may include a keypad connected to the control unit to send the input to the control unit, and a doorbell button connected to the control unit.

The barrier control system may further include an inner portion, including a speaker disposed on at least a portion of the main body to emit a doorbell ring in response to depressing the doorbell button.

The barrier control system may further include at least one sensor disposed on at least a portion of the main body and connected to the control unit to receive a sensor reading thereon, such that the control unit moves the main body in response to the sensor reading matching a list of sensor readings for authorized users.

The barrier control system may further include at least one camera disposed on at least a portion of the main body and connected to the control unit to record at least one of at least one picture and at least one video therein.

The barrier control system may further include at least one light disposed on at least a portion of the main body and connected to the control unit to illuminate a surrounding area of the main body.

The control unit may adjust a size of a target area from the at least one light.

The control unit may adjust the target area of the at least one light by at least one of increasing and decreasing a size of an illuminated area.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1:
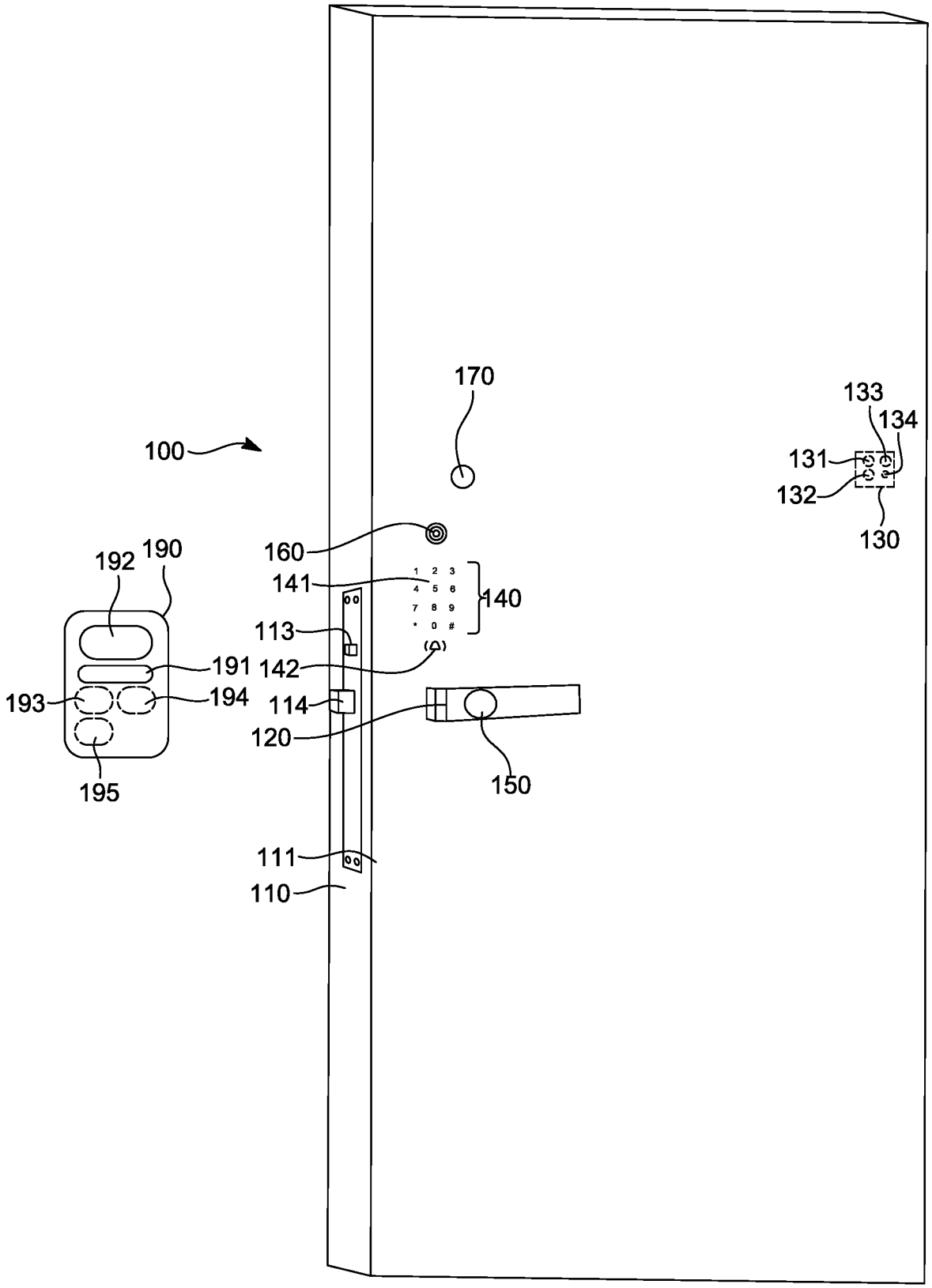
FIG. 1 illustrates a front perspective view of a barrier control system, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Barrier Control System 100
Main Body 110
First Side 111
Second Side 112
Latch 113
Deadbolt 114
Handle 120
Control Unit 130
Processing Unit 131
Communication Unit 132
Storage Unit 133
Motor 134
Input Unit 140
Keypad 141
Doorbell Button 142
Sensor 150
Camera 160
Light 170
Inner Portion 180
Display Unit 181
Speaker 182
Power Source 183
Deadbolt Switch 184
Control Device 190
Input Unit 191
Display Unit 192
Processing Unit 193
Communication Unit 194
Storage Unit 195

FIG. 1 illustrates a front perspective view of a barrier control system 100, according to an exemplary embodiment of the present general inventive concept.

Figure 2:
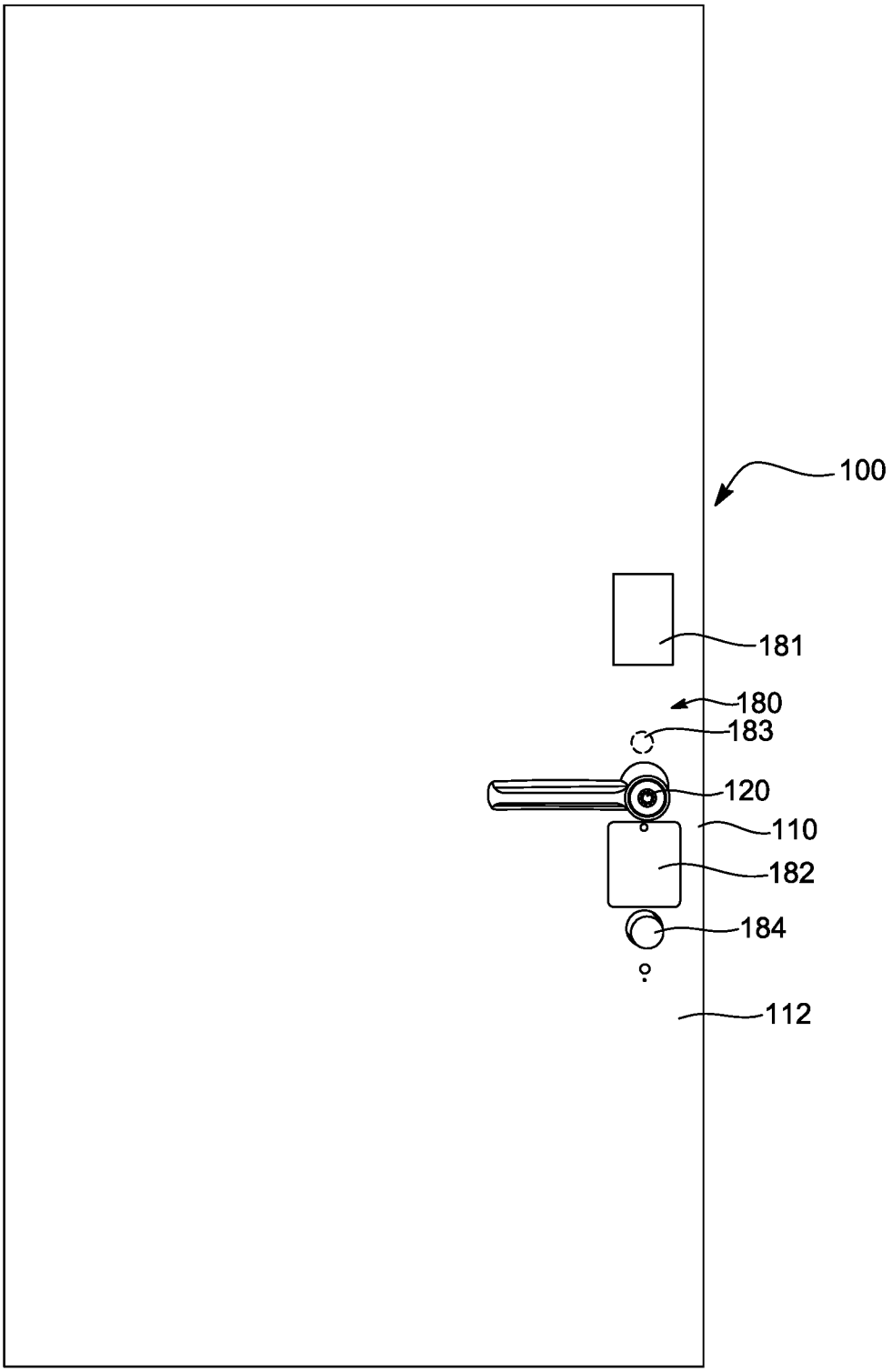
FIG. 2 illustrates a rear perspective view of the barrier control system, according to an exemplary embodiment of the present general inventive concept.

FIG. 2 illustrates a rear perspective view of the barrier control system 100, according to an exemplary embodiment of the present general inventive concept.

The barrier control system 100 may be constructed from at least one of metal, plastic, wood, glass, and rubber, etc., but is not limited thereto.

The barrier control system 100 may include a main body 110, a handle 120 120, a control unit 130, an input unit 140, at least one sensor 150, at least one camera 160, at least one light 170, an inner portion 180, and at least one control device 190, but is not limited thereto.

Referring to FIGS. 1 and 2, the main body 110 is illustrated to be a door leaf. However, the main body 110 may be a fence, a gate, a rail, a bollard, and/or any other barrier known to one of ordinary skill in the art, but is not limited thereto.

The main body 110 may include a first side 111, a second side 112, a latch 113, and a deadbolt 114, but is not limited thereto.

The first side 111 may be an exterior surface of the main body 110. In other words, the first side 111 may be disposed on at least a portion of an exterior side of a building, such that the first side 111 may be exposed to an outside environment. Alternatively, the first side 111 may be disposed on at least a portion of an interior side of the building.

The second side 112 may be an interior surface of the main body 110. In other words, the second side 112 may be disposed on at least a portion of the interior side of the building, such that the second side 112 may be exposed to an inside environment. Alternatively, the second side 112 may be disposed on at least a portion of the exterior side of the building.

The latch 113 may be movably (i.e. slidably) disposed within at least a portion of an interior of the main body 110. Moreover, the latch 113 may perpendicularly extend away from the interior of the main body 110 with respect to a lateral direction.

The deadbolt 114 may be movably (i.e. slidably) disposed within at least a portion of the interior of the main body 110. Moreover, the latch 113 may perpendicularly extend away from the interior of the main body 110 with respect to the lateral direction. As such, the deadbolt 114 may be disposed in parallel with the latch 113.

The handle 120 may be disposed on at least a portion of the first side 111 and/or the second side 112 of the main body 110. Additionally, the handle 120 may be mechanically and/or electrically connected to the latch 113. As such, the latch 113 may move from extended in a first position to at least partially retracted in a second position in response to rotation of the handle 120. Accordingly, the handle 120 may be used to open and/or close the main body 110.

The control unit 130 may include a processing unit 131, a communication unit 132, a storage unit 133, and at least one motor 134, but is not limited thereto.

The control unit 130 may be disposed within at least a portion of the main body 110.

The processing unit 131 (or central processing unit, CPU) may include electronic circuitry to carry out instructions of a computer program by performing basic arithmetic, logical, control and input/output (I/O) operations specified by the instructions. The processing unit 131 may include an arithmetic logic unit (ALU) that performs arithmetic and logic operations, processor registers that supply operands to the ALU and store the results of ALU operations, and a control unit that fetches instructions from memory and "executes" them by directing the coordinated operations of the ALU, registers and other components. The processing unit 131 may also include a microprocessor and a microcontroller.

The communication unit 132 may include a device capable of wireless or wired communication between other wireless or wired devices via at least one of Wi-Fi, Wi-Fi Direct, infrared (IR) wireless communication, satellite communication, broadcast radio communication, Microwave radio communication, Bluetooth, Bluetooth Low Energy (BLE), Zigbee, near field communication (NFC), and radio frequency (RF) communication, USB, global positioning system (GPS), Firewire, and Ethernet.

The storage unit 133 may include a random access memory (RAM), a read-only memory (ROM), a hard disk, a flash drive, a database connected to the Internet, cloud-based storage, Internet-based storage, or any other type of storage unit.

The processing unit 131 may access the Internet via the communication unit 132 to allow the user to access a website, and/or may allow a mobile application and/or the software application to be executed using the processing unit 131. For ease of description, the mobile and/or the software application will be hereinafter referred to as an app. The app may be downloaded from the Internet to be stored on the storage unit 133. Also, the processing unit 131, the communication unit 132, and/or the storage unit 133 may be mechanically and/or electrically connected to the latch 113, the deadbolt 114, and/or the handle 120, such that the processing unit 131 via the app may control operations of the main body 110.

The at least one motor 134 may be mechanically and/or electrically connected to at least a portion of a hinge of the main body 110, the latch 113, and/or the deadbolt 114. Alternatively, the at least one motor 134 may also function as the hinge of the main body 110. As such, the main body 110 may move (i.e. rotate and/or pivot) with respect to a casing and/or a door jamb of the main body 110. As such, the main body 110 may move in a first lateral direction or a second lateral direction in response to a first rotation direction of the at least one motor 134. Conversely, the main body 110 may move in the second lateral direction or the first lateral direction in response to a second rotation direction of the at least one motor 134. In other words, the main body 110 may move to open and/or close based on the rotation of the at least one motor 134. Therefore, the main body 110 may move automatically without an application of force by a user.

Furthermore, the latch 113 may move from extended in a first position to at least partially retracted in a second position in response to the first rotation direction or the second rotation direction of the at least one motor 134. Conversely, the latch 113 may move from retracted in the second position to extended in the first position in response to the second rotation direction or the first rotation direction of the at least one motor 134. In other words, the latch 113 may move to unlock and/or lock based on the rotation of the at least one motor 134. Therefore, the latch 113 may move automatically without an application of force by the user.

Similarly, the deadbolt 114 may move from extended in a first position to at least partially retracted in a second position in response to the first rotation direction or the second rotation direction of the at least one motor 134. Conversely, the deadbolt 114 may move from retracted in the second position to extended in the first position in response to the second rotation direction or the first rotation direction of the at least one motor 134. In other words, the deadbolt 114 may move to unlock and/or lock based on the rotation of the at least one motor 134. Therefore, the deadbolt 114 may move automatically without an application of force by the user.

The at least one motor 134 may be a plurality of motors and/or a single motor. In the case of the single motor, the at least one motor 134 may use a plurality of gears to control the main body 110, the latch 113, and/or the deadbolt 114 depending on the plurality of gears connected to the at least one motor 134. As such, the at least one motor 134 may simultaneously and/or alternately control the main body 110, the latch 113, and/or the deadbolt 114.

The input unit 140 may include a keypad 141 and a doorbell button 142, but is not limited thereto.

The keypad 141 may include a plurality of mechanical keys and a touchscreen display of keys, but is not limited thereto.

The keypad 141 may be disposed on at least a portion of the first side 111 of the main body 110, such that the keypad 141 may be flush with the main body 110. The keypad 141 may include any combination of alphanumeric keys (e.g., letters A through Z, numbers 0-9). The keypad 141 may be mechanically and/or electrically connected to at least a portion of the control unit 130. They keypad 141 may be receive an input thereon, such that the keypad 141 may send the input to the control unit 130. Moreover, the processing unit 131 via the app may compare a received input to at least one authorized input. The processing unit 131 executing the app may transmit an authorized signal to the motor 134 to move the main body 110, the latch 113, and/or the deadbolt 114 in response to the received input matching the at least one authorized input.

Alternatively, the keypad 141 may be a microphone to receive at least one audio input therein. As such, the keypad 141 may provide vocal recognition, such that the processing unit 131 may execute the app to compare the received input to the at least one authorized input. Accordingly, the processing unit 131 executing the app may transmit the authorized signal to the motor 134 to move the main body 110, the latch 113, and/or the deadbolt 114 in response to the received input matching the at least one authorized input.

Additionally, the keypad 141 may be a card reader to receive a near field communication (NFC) device to determine the at least one authorized signal. Also, the keypad 141 may be a mechanical lock to receive a key.

The doorbell button 142 may include a mechanical button and a touch-screen display of a button, but is not limited thereto.

The doorbell button 142 may be disposed on at least a portion of the first side 111 of the main body 110, such that the doorbell button 142 may be flush with the main body 110. The doorbell button 142 may be mechanically and/or electrically connected to at least a portion of the control unit 130.

The at least one sensor 150 may include a temperature sensor, a motion sensor, a smoke sensor, a fire sensor, and a biometric sensor (e.g., fingerprint, iris, face), but is not limited thereto.

Referring again to FIG. 1, the at least one sensor 150 is illustrated to be disposed on the handle 120. However, the at least one sensor 150 may be disposed at any portion of the main body 110, such as any portion of the first side 111, such that the at least one sensor 150 may be flush with the main body 110. Additionally, the at least one sensor 150 may be mechanically and/or electrically connected to at least a portion of the control unit 130. The storage unit 133 may store a list of sensor readings for authorized users therein. As such, the processing unit 131 may compare a sensor reading (e.g., a temperature level, a fingerprint, an eye, a face structure) from the at least one sensor 150 to the list of sensor readings for authorized users. The processing unit 131 executing the app may transmit the authorized signal to the motor 134 to move the main body 110, the latch 113, and/or the deadbolt 114 in response to the received input matching the at least one authorized input, such that the deadbolt 114 may be unlocked and/or the main body 110 may move. In other words, the main body 110 may automatically move (i.e. open) to allow the authorized users to enter. Therefore, the at least one sensor 150 may facilitate control of the main body 110, the latch 113, and/or the deadbolt 114.

The at least one camera 160 may include any type of camera known to one of ordinary skill in the art, including, but not limited to, an action camera, an animation camera, an autofocus camera, a box camera, a camcorder, a camera phone, a compact camera, a dashboard camera (i.e., a Dashcam), a digital camera, a field camera, a FIREWIRE camera, a helmet camera, a high-speed camera, an instant camera, a keychain camera, a live-preview digital camera, a movie camera, an omnidirectional camera, a pinhole camera, a pocket camera, a pocket video camera, a rangefinder camera, a reflex camera, a remote camera, a stereo camera, a still camera, a still video camera, a subminiature camera, a system camera, a thermal imaging camera, a thermographic camera, a traffic camera, a traffic enforcement camera, a twin-lens reflex camera, a video camera, a view camera, a webcam, a WRIGHT camera, a ZENITH camera, a zoom-lens reflex camera.

The at least one camera 160 may be disposed on at least a portion of the first side 111 of the main body 110, such that the at least one camera 160 may be flush with the main body 110. Additionally, the at least one camera 160 may be mechanically and/or electrically connected to at least a portion of the control unit 130. The camera 160 may record at least one picture and/or at least one video thereon, such that the storage unit 133 may store the at least one picture and/or the at least one video.

The at least one light 170 may include an incandescent bulb, a fluorescent lamp, a neon light, a halogen light, a light emitting diode (LED), an arc light, a gas discharge lamp, and a high intensity discharge lamp, but is not limited thereto.

The at least one light 170 may be disposed no at least a portion of the first side 111 of the main body 110, such that the at least one light 170 may be flush with the main body 110. Additionally, the at least one camera 160 may be mechanically and/or electrically connected to at least a portion of the control unit 130. The at least one light 170 may illuminate a surrounding area of the main body 110. Alternatively, the processing unit 131 may execute the app to adjust a target area of the at least one light 170. For example, the processing unit 131 may execute the app to adjust a size (e.g., a width, a diameter) of the target area from the at least one light 170, such that the at least one light 170 may increase and/or decrease a size of an illuminated area.

The inner portion 180 may include a display unit 181, a speaker 182, a power source 183, and a deadbolt switch 184, but is not limited thereto.

The display unit 181 may include a plasma screen, an LCD screen, a light emitting diode (LED) screen, an organic LED (OLED) screen, a computer monitor, a hologram output unit, a sound outputting unit, or any other type of device that visually or aurally displays data.

The display unit 181 may be disposed on at least a portion of the second side 112 of the main body 110, such that the display unit 181 may be flush with the main body 110. Additionally, the display unit 181 may be mechanically and/or electrically connected to at least a portion of the control unit 130 and/or the at least one camera 160. The display unit 181 may display the at least one picture and/or the at least one video recorded from the at least one camera 160. In other words, the display unit 181 may receive the at least one picture and/or the at least one video recorded from the at least one camera 160.

The speaker 182 may include a microphone, but is not limited thereto.

The speaker 182 may be disposed on at least a portion of the second side 112 of the main body 110, such that the speaker 182 may be flush with the main body 110. Moreover, the speaker 182 may emit at least one sound therefrom. For example, the speaker 182 may emit a doorbell ring, a song (i.e. music), a voice, a beep, and/or any other type of sound, such as the received input from the keypad 141. Also, the speaker 182 may emit the doorbell ring in response to the doorbell button 142 being depressed. Alternatively, and/or in addition thereto, the speaker 182 may receive at least one external sound therein to facilitate audio communication through the keypad 141.

The power source 183 may include a battery and a solar cell, but is not limited thereto.

The power source 183 may provide power to control unit 130, the input unit 140, the at least one sensor 150, the at least one camera 160, the at least one light 170, and/or the inner portion 180.

The deadbolt switch 184 may be movably (i.e. rotatably) disposed on at least a portion of the second side 112 of the main body 110. The deadbolt 114 may move from extended in a first position to at least partially retracted in a second position in response to rotation of the deadbolt switch 184 in a first rotational direction. Conversely, the deadbolt 114 may move from retracted in the second position to extended in the first position in response to rotation of the deadbolt switch 184 in a second rotational direction.

All aforementioned components including the control unit 130, the input unit 140, the at least one sensor 150, the at least one camera 160, the at least one light 170, and/or the inner portion 180 may be flush with an outer surface of the first side 111 and/or the second side 112 of the main body 110.

The at least one control device 190 may include an input unit 191, a display unit 192, a processing unit 193, a communication unit 194, and a storage unit 195, but is not limited thereto.

The at least one control device 190 may be a radio controller (RC), a mobile phone, a tablet computer, a laptop computer, a personal digital assistant (PDA), and/or a computer of a vehicle.

The input unit 191 may include a keyboard, a touchpad, a mouse, a trackball, a stylus, a voice recognition unit, a visual data reader, a camera, a wireless device reader, a fingerprint reader, an iris scanner, a facial recognition unit, and a holographic input unit.

The display unit 192 may include a plasma screen, an LCD screen, a light emitting diode (LED) screen, an organic LED (OLED) screen, a computer monitor, a hologram output unit, a sound outputting unit, or any other type of device that visually or aurally displays data.

Also, the display unit 192 may be combined with the input unit 191 to be a touch-screen.

The processing unit 193 (or central processing unit, CPU) may include electronic circuitry to carry out instructions of a computer program by performing basic arithmetic, logical, control and input/output (I/O) operations specified by the instructions. The processing unit 193 may include an arithmetic logic unit (ALU) that performs arithmetic and logic operations, processor registers that supply operands to the ALU and store the results of ALU operations, and a control unit that fetches instructions from memory and "executes" them by directing the coordinated operations of the ALU, registers and other components. The processing unit 193 may also include a microprocessor and a microcontroller.

The communication unit 194 may include a device capable of wireless or wired communication between other wireless or wired devices via at least one of Wi-Fi, Wi-Fi Direct, infrared (IR) wireless communication, satellite communication, broadcast radio communication, Microwave radio communication, Bluetooth, Bluetooth Low Energy (BLE), Zigbee, near field communication (NFC), and radio frequency (RF) communication, USB, global positioning system (GPS), Firewire, and Ethernet.

The storage unit 195 may include a random access memory (RAM), a read-only memory (ROM), a hard disk, a flash drive, a database connected to the Internet, cloud-based storage, Internet-based storage, or any other type of storage unit.

The at least one control device 190 may access the Internet via the communication unit 194 to allow the user to access a website, and/or may allow the app to be executed using the processing unit 193. The app may be downloaded from the Internet to be stored on the storage unit 195. In other words, the software application stored on the storage unit 133 of the control unit 130 may be the same as the app stored on the storage unit 195 of the at least one control device 190.

The at least one control device 190 may use the app via the input unit 191 and/or the communication unit 194 to allow the user to control the control unit 130 via the communication unit 132, the input unit 140, the at least one sensor 150, the at least one camera 160, the at least one light 170, and/or the inner portion 180. The control unit 130 may execute instructions on the app in response to a command from the processing unit 193 of the at least one control device 190 using the app. Moreover, the processing unit 193 may execute the app to change settings of the control unit 130, such that movement of the main body 110, the latch 113 and/or the deadbolt 114 adjusts in response to movement of the at least one motor 134.

Additionally, the processing unit 193 may execute the app to change settings of the at least one authorized input stored on the storage unit 133 to be compared to the received input by the processing unit 131. The processing unit 193 may execute the app to adjust a target area of the at least one light 170. For example, the processing unit 193 may execute the app to adjust the size (e.g., a width, a diameter) of the target area from the at least one light 170, such that the at least one light 170 may increase and/or decrease a size of an illuminated area. Also, the processing unit 193 may execute the app to adjust the doorbell ring, the song, and/or the beep from the speaker 182. In other words, the processing unit 193 may execute the app to customize the doorbell ring, such as based on an input on the input unit 191. Alternatively, the processing unit 193 may display the doorbell ring and/or emit the doorbell ring in response to the doorbell button 142 being depressed. Additional external electronic devices may be connected within the building that also provide similar visual and/or audio alerts of the doorbell ring, such that multiple users may be aware of the doorbell ringing.

Also, the processing unit 193 may execute the app in response to receiving the input on the input unit 191 to schedule a time for events, such as reminders of maintenance for the main body 110, the control unit 130, the input unit 140, the at least one sensor 150, the at least one camera 160, the at least one light 170, and/or the inner portion 180. The processing unit 193 may execute the app in response to receiving the input on the input unit 191 to schedule a time for moving the main body 110 via the at least one motor 134, the latch 113, and/or the deadbolt 114, such that the main body may unlock and/or open in response to a time of arrival of at least one authorized user. Conversely, the processing unit 193 may execute the app in response to receiving the input on the input unit 191 to schedule a time for moving the main body 110 via the at least one motor 134, the latch 113, and/or the deadbolt 114, such that the main body 100 may lock and/or close.

Alternatively, the processing unit 131 of the control unit 130 and/or the processing unit 191 may execute the app to automatically schedule the time for events and/or schedule the time for moving the main body 110 via the at least one motor 134, the latch 113, and/or the deadbolt 114 based on predetermined settings. For example, the processing unit 193 may execute the app to display on the display unit 192 a schedule of the time for events, such as a time of day, a day of a week, month, and/or year, the processing unit 131 detecting a defective component. Also, the processing unit 131 may execute the app to automatically schedule the time for moving the main body 110 via the at least one motor 134, the latch 113, and/or the deadbolt 114 based on operation patterns.

Accordingly, the input unit 191 may receive the input to schedule the time for events and/or schedule the time for moving the main body 110 via the at least one motor 134, the latch 113, and/or the deadbolt 114. Alternatively, the processing unit 131 and/or the processing unit 191 may execute the app to learn the operation patterns to perform the schedule for events based on a history of the processing unit 131 detecting defects of the control unit 130, the input unit 140, the at least one sensor 150, the at least one camera 160, the at least one light 170, and/or the inner portion 180. For example, the processing unit 131 may execute the app to performing the schedule for events based on defects occurring a number of times (e.g., 2 times, 5 times, 10 times).

Also, the processing unit 191 and/or the processing unit 131 may execute the app to learn the operation patterns to schedule the time for moving the main body 110 via the at least one motor 134, the latch 113, and/or the deadbolt 114 based on a history of movement of the main body 110 via the at least one motor 134, the latch 113, and/or the deadbolt 114. For example, the processing unit 131 may execute the app to perform the schedule for moving based on movement occurring within a predetermined time (e.g., 4:00 pm, 5:00 pm, 6:00 pm, etc.).

As such, the processing unit 191 and/or the processing unit 131 may automatically change the schedule for events and/or the schedule for moving in response to a change in the operation patterns.

However, the main body 110, the latch 113, and/or the deadbolt 114 may remain in position (e.g., closed) in response to the at least one sensor 150 and/or the at least one camera 160 detecting presence of a person and/or an object obstructing and/or preventing the main body 110 from moving (e.g., opening).

The control unit 130 may provide additional applications. The processing unit 131 of the control unit 130 and/or the processing unit 191 may execute the app to determine facial recognition and/or image recognition using the at least one sensor 150 and/or the at least one camera 160. For example, the at least one sensor 150 and/or the at least one camera 160 may receive instructions from the processing unit 131 and/or the processing unit 191 executing the app to monitor the arrival of at least one parcel delivery person (e.g., FedEx, United Parcel Service (UPS), United States Postal Service (USPS), etc.). As such, the at least one sensor 150 and/or the at least one camera 160 may scan a face, an eye, and/or an identification tag of the at least one parcel delivery person, such that the face, the eye, and/or the identification tag of the at least one parcel delivery person may be compared to a plurality of faces, a plurality of eyes, and/or a plurality of identification tags stored the storage unit 133, the storage unit 195, and/or a database connected to the Internet. Accordingly, the main body 110, the latch 113, and/or the deadbolt 114 may automatically move (i.e. open and/or unlock) in response to the face, the eye, and/or the identification tag of the at least one parcel delivery person matching at least one of the plurality of faces, the plurality of eyes, and/or the plurality of identification tags, such that the at least one parcel delivery person may enter therethrough. Alternatively, the main body 110, the latch 113, and/or the deadbolt 114 may remain in position (i.e. closed) in response to the at least one sensor 150 and/or the at least one camera 160 determining a lack of a match of the face, the eye, and/or the identification tag of the at least one parcel delivery person to at least one of the plurality of faces, the plurality of eyes, and/or the plurality of identification tags.

Furthermore, the at least one sensor 150 and/or the at least one camera 160 may receive instructions from the processing unit 131 and/or the processing unit 191 executing the app to monitor an approach of a child (i.e. the at least one authorized user), for example. The processing unit 131 and/or the processing unit 191 may determine a facial emotion of the child, such as happiness, smiling, distress, worry, sadness, fear, anger, etc. Accordingly, the processing unit 131 and/or the processing unit 191 may send a quick response signal to the at least one motor 134 to move the main body 110 (i.e., close the door, for example) once the child has crossed a door threshold in response to determining the facial emotion of the child is distress, sadness, and/or fear and detecting a face of at least one unauthorized user (e.g., a kidnapper, a bully, etc.). Moreover, the processing unit 131 and/or the processing unit 191 may automatically store the face of the at least one unauthorized user to on a user blacklist stored on the storage unit 133 and/or the storage unit 195. As such, the processing unit 131 may learn and/or adapt to recognize the at least one unauthorized user. Also, the processing unit 131 may contact at least one third party (e.g., a police, a fire fighter, a family member) in response to detecting the at least one unauthorized user has approached the main body 110 within a predetermined range (e.g., one foot, two feet, three feet, five feet) and/or has remained within the predetermined range for a predetermined amount of time (e.g., five seconds, ten seconds, twenty seconds, thirty seconds), such that the processing unit 131 may determine the at least one unauthorized user is a threat and/or a danger.

The speaker 182 may monitor a tone of speech of the at least one authorized user in response to arrival of the at least one authorized user entering the building through the main body 110. Moreover, the processing unit 131 executing the app may compare the tone of speech of the at least one authorized user to a plurality of tones of speech (e.g., excited, high pitch, happy, sad, low, rough) stored in the storage unit 133. As such, the processing unit 131 may play at least one happy song through the speaker 182 (e.g., based on a ranking among a plurality of users that the song is a happy song) stored on the storage unit 133 to improve a mood of the at least one authorized user in response to the processing unit 131 determining the tone of speech of the at least one authorized user matches a sad, low, and/or rough tone. In other words, the processing unit 131 may attempt to improve the mood of the at least one unauthorized user that may be having a bad day after returning home.

Also, and/or in addition to the aforementioned features, the input unit 140 may have an electrical discharge unit (e.g., a taser) disposed on at least a portion of the keypad 141 and/or the doorbell button 142. The at least one sensor 150 and/or the at least one camera 160 may monitor a portion of a body of a person thereon (e.g., a finger, a hand, etc.), as well as a face and/or an eye of the person. The processing unit 131 may compare the face, the eye, and/or the portion of the body of the person on the input unit to compare to a face, an eye, and/or a portion of a body of the at least one authorized user. As such, the processing unit 131 may send an electrical discharge signal to the electrical discharge unit to electrocute the person in response to determining a lack of a match of the face, the eye, and/or the portion of the body of the person to the face, the eye, the portion of the body of the at least one authorized user.

Therefore, the barrier control system 100 may provide an integrated solution for a barrier, such as the main body 110. As such, the integration of the control unit 130 may provide a means to control operations of the barrier control system 100 without having to worry about retrofitting.

The present general inventive concept may include a barrier control system 100 running a program thereon, the barrier control system 100 including a main body 110, a control unit 130 disposed within at least a portion of the main body 110 to execute the program to control operations of the main body 110, and at least one control device 190 connected to the control unit 130 to control operations of the main body 110 through the control unit 130 based on the program.

The main body 110 may include a latch 113 movably disposed within at least a portion of an interior of the main body 110 to perpendicularly extend away from the interior of the main body 110 with respect to a lateral direction, and a deadbolt 114 movably disposed within at least a portion of the interior of the main body 110 to perpendicularly extend away from the interior of the main body 110 with respect to the lateral direction.

The control unit 130 may include at least one motor 134 connected to main body 110, the latch 113 and the deadbolt 114 to move the main body 110, the latch 113, and the deadbolt 114 in response to rotation of the at least one motor.

The at least one motor 134 may be a hinge of the main body 110.

The at least one control device 190 may schedule a time for a schedule for events for the main body 110 and the control unit 130.

The at least one control device 190 may use the program to learn operation patterns to perform the schedule for events based on defects occurring within the main body 110 and the control unit 130 a number of times.

The at least one control device 190 may schedule a time for a schedule for moving the main body 110 and the at least one motor 134.

The at least one control device 190 may use the program to learn operation patterns to perform the schedule for moving the main body 110 and the at least one motor 134 based on movement occurring within a predetermined time.

The barrier control system 100 may further include an input unit 140 disposed on at least a portion of the main body 110 to receive an input thereon, such that the control unit 130 executes the program to compare the input to at least one authorized input.

The input unit 140 may include a keypad 141 connected to the control unit 130 to send the input to the control unit 130, and a doorbell button 142 connected to the control unit 130.

The barrier control system 100 may further include an inner portion 180, including a speaker 182 disposed on at least a portion of the main body 110 to emit a doorbell ring in response to depressing the doorbell button 142.

The barrier control system 100 may further include at least one sensor 150 disposed on at least a portion of the main body 110 and connected to the control unit 130 to receive a sensor reading thereon, such that the control unit 130 moves the main body 110 in response to the sensor reading matching a list of sensor readings for authorized users.

The barrier control system 100 may further include at least one camera 160 disposed on at least a portion of the main body 110 and connected to the control unit 130 to record at least one of at least one picture and at least one video therein.

The barrier control system 100 may further include at least one light 170 disposed on at least a portion of the main body 110 and connected to the control unit 130 to illuminate a surrounding area of the main body 110.

The control unit 130 may adjust a size of a target area from the at least one light 170.

The control unit 130 may adjust the target area of the at least one light 170 by at least one of increasing and decreasing a size of an illuminated area.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A barrier control system comprising:

a main body;

a control unit running a program thereon and disposed within at least a portion of the main body to execute the program to control operations of the main body, such that the main body moves in response to movement of a portion of the control unit in absence of an external application of force; and at least one control device connected to the control unit to control operations of the main body through the control unit based on the program.

2. The barrier control system of claim 1, wherein the main body comprises:

a latch movably disposed within at least a portion of an interior of the main body to perpendicularly extend away from the interior of the main body with respect to a lateral direction; and a deadbolt movably disposed within at least a portion of the interior of the main body to perpendicularly extend away from the interior of the main body with respect to the lateral direction.

3. The barrier control system of claim 2, wherein the control unit comprises:

at least one motor connected to main body, the latch and the deadbolt to move the main body, the latch, and the deadbolt in response to rotation of the at least one motor.

4. The barrier control system of claim 3, wherein the at least one motor is a hinge of the main body.

5. The barrier control system of claim 3, wherein the at least one control device schedules a time for a schedule for events for the main body and the control unit.

6. The barrier control system of claim 5, wherein the at least one control device uses the program to learn operation patterns to perform the schedule for events based on defects occurring within the main body and the control unit a number of times.

7. The barrier control system of claim 3, wherein the at least one control device schedules a time for a schedule for moving the main body and the at least one motor.

8. The barrier control system of claim 7, wherein the at least one control device uses the program to learn operation patterns to perform the schedule for moving the main body and the at least one motor based on movement occurring within a predetermined time.

9. The barrier control system of claim 1, further comprising:

an input unit disposed on at least a portion of the main body to receive an input thereon, such that the control unit executes the program to compare the input to at least one authorized input.

10. The barrier control system of claim 9, wherein the input unit comprises:

a keypad connected to the control unit to send the input to the control unit; and a doorbell button connected to the control unit.

11. The barrier control system of claim 10, further comprising:

an inner portion, comprising:

a speaker disposed on at least a portion of the main body to emit a doorbell ring in response to depressing the doorbell button.

12. The barrier control system of claim 1, further comprising:

at least one sensor disposed on at least a portion of the main body and connected to the control unit to receive a sensor reading thereon, such that the control unit moves the main body in response to the sensor reading matching a list of sensor readings for authorized users.

13. The barrier control system of claim 1, further comprising:

at least one camera disposed on at least a portion of the main body and connected to the control unit to record at least one of at least one picture and at least one video therein.

14. The barrier control system of claim 1, further comprising:

at least one light disposed on at least a portion of the main body and connected to the control unit to illuminate a surrounding area of the main body.

15. The barrier control system of claim 14, wherein the control unit adjusts a size of a target area from the at least one light.

16. The barrier control system of claim 15, wherein the control unit adjusts the target area of the at least one light by at least one of increasing and decreasing a size of an illuminated area.

* * * * *